United States Patent [19]

Saitoh et al.

[11] Patent Number: 5,069,605

[45] Date of Patent: Dec. 3, 1991

[54] SCROLL FLUID MACHINE HAVING A SEALING MEMBER RADIALLY INWARDLY OF A THRUST BEARING

[75] Inventors: Takashi Saitoh; Kohji Fukui, both of Kanagawa, Japan

[73] Assignee: Tokico Ltd., Kanagawa, Japan

[21] Appl. No.: 493,152

[22] Filed: Mar. 14, 1990

[30] Foreign Application Priority Data

Mar. 20, 1989 [JP] Japan ..... 1-69024

[51] Int. Cl.[5] ..... F01C 1/04; F01C 19/00

[52] U.S. Cl. ..... 418/55.2; 418/55.4; 418/143

[58] Field of Search ..... 418/55.1, 55.2, 55.4, 418/130, 143

[56] References Cited

U.S. PATENT DOCUMENTS 3,994,633 11/1976 Shaffer ..... 418/55.1
4,466,784 8/1984 Hiraga ..... 418/55.1

FOREIGN PATENT DOCUMENTS 55-64180 5/1980 Japan ..... 418/55.4
57-68579 4/1982 Japan ..... 418/55.4
59-192884 11/1984 Japan ..... 418/55.4

*Primary Examiner*—John J. Vrablik
*Attorney, Agent, or Firm*—Wenderoth, Lind & Ponack; Wenderoth, Lind & Ponack

[57] ABSTRACT

A scroll fluid machine, such as a scroll vacuum pump or a scroll compressor, is disclosed and is capable of discharging substantially oil-free fluid. The scroll fluid machine comprises a casing, a drive shaft having an eccentric shaft portion, a scroll rotor supported on the eccentric portion of the drive shaft for revolution and having a scroll wrap, a scroll stator having a scroll wrap and attached to the open end of the casing with its scroll wrap in engagement with that of the scroll rotor to define a closed fluid compressing space together with the scroll wrap of the scroll rotor. Thrusts acting on the scroll rotor are sustained by thrust bearing portions formed in the end surface of the scroll stator, and an annular sealing member preformed of a flexible material in a U shape is disposed in a space defined between and by the scroll rotor and the scroll stator to isolate the closed fluid compressing space from the interior of the casing. Lubricating oil is splashed on the bearings and the scroll rotor to effect lubrication and cooling thereof.

4 Claims, 3 Drawing Sheets

SCROLL FLUID MACHINE HAVING A SEALING MEMBER RADIALLY INWARDLY OF A THRUST BEARING

BACKGROUND OF THE INVENTION

1. Field of the Invention

The present invention relates to a scroll fluid machine, such as a scroll vacuum pump or a scroll compressor, and, more particularly, to a scroll type fluid machine comprising a scroll rotor and a scroll stator and is capable of operating without lubricating the scroll rotor and the scroll stator.

2. Description of the Prior Art

An oil-free scroll fluid machine, in general, comprises a casing; a drive shaft supported for rotation on the casing and provided with an eccentric shaft portion extending within the casing; a scroll rotor consisting of a mirror-finished base plate and a rotor scroll wrap standing upright on the base plate, and supported on a bearing on the eccentric shaft portion of the drive shaft; and a scroll stator attached to the casing, consisting of a base block having a mirror-finished surface and a rotor scroll wrap standing upright on the mirror-finished surface of the base block so as to define a closed space together with the rotor scroll wrap, and provided with a suction port in its peripheral portion and a discharge port in its central portion.

When this oil-free scroll fluid machine is used as a vacuum pump, a closed vessel to be evacuated, such as a vacuum tank, is connected to the suction port, the scroll rotor is revolved by driving the drive shaft via a motor or the like to suck air from the closed vessel into the closed space between the rotor scroll wrap of the scroll rotor and the stator scroll wrap of the scroll stator and to discharge the air through the discharge port. Thus, pumping action is effected to evacuate the closed vessel.

The interior of the casing is in a vacuum state during the pumping action since the suction port is constantly connected to the interior of the casing. Heat generated by the compression of air in the closed space between the scroll rotor and the scroll stator during the pumping action is transmitted through the scroll rotor to the interior of the casing since the casing covers the rear side of the scroll rotor. Further, the radial bearings and the thrust bearing provided in the casing generate frictional heat during the pumping action.

Accordingly, the interior of the casing is heated to a high temperature, thus accelerating the abrasion of the bearings due to insufficient cooling and lubrication of the bearings or, at worst, such an elevated temperature can cause thermal deformation of the scroll rotor.

Although free from problems relating to lubrication and cooling, an oil-cooled vacuum pump or compressor has an undesirable effect in that it discharges air mixed with the lubricant.

SUMMARY OF THE INVENTION

Accordingly, it is an object of the present invention to provide a scroll fluid machine wherein the interior of its casing is maintained in an atmospheric condition by the isolation of its suction mechanism, including a suction port, from the interior of the casing, and wherein satisfactorily cooling of the bearings and components is achieved.

To achieve these objects, the present invention provides a scroll fluid machine comprising a casing, a scroll stator, a scroll rotor engaging the scroll stator, thrust bearing portions formed on the peripheral portions of the scroll rotor and scroll stator to sustain a thrust acting on the scroll rotor, and an annular sealing member having a U-shaped cross section and disposed within a space defined by the scroll stator and the scroll rotor and connected to a suction port formed in the scroll stator to isolate the space from the interior of the casing, the sealing member being located radially inwardly of the thrust bearing portions.

Thus, the interior of the casing is hermetically isolated from the suction port to maintain the interior of the casing in an atmospheric condition. Therefore, the casing may contain lubricating oil or the like to lubricate and cool the bearings, and the sealing member effectively prevents any leakage of the lubricating oil into the suction port, so that the scroll fluid machine discharges clean air. Having a U-shaped cross section, the sealing member is free from stress concentration during the operation of the scroll fluid machine and hence is able to function effectively for an extended period of time.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

The present invention will be described hereinafter as applied to scroll vacuum pumps.

Figure 1:
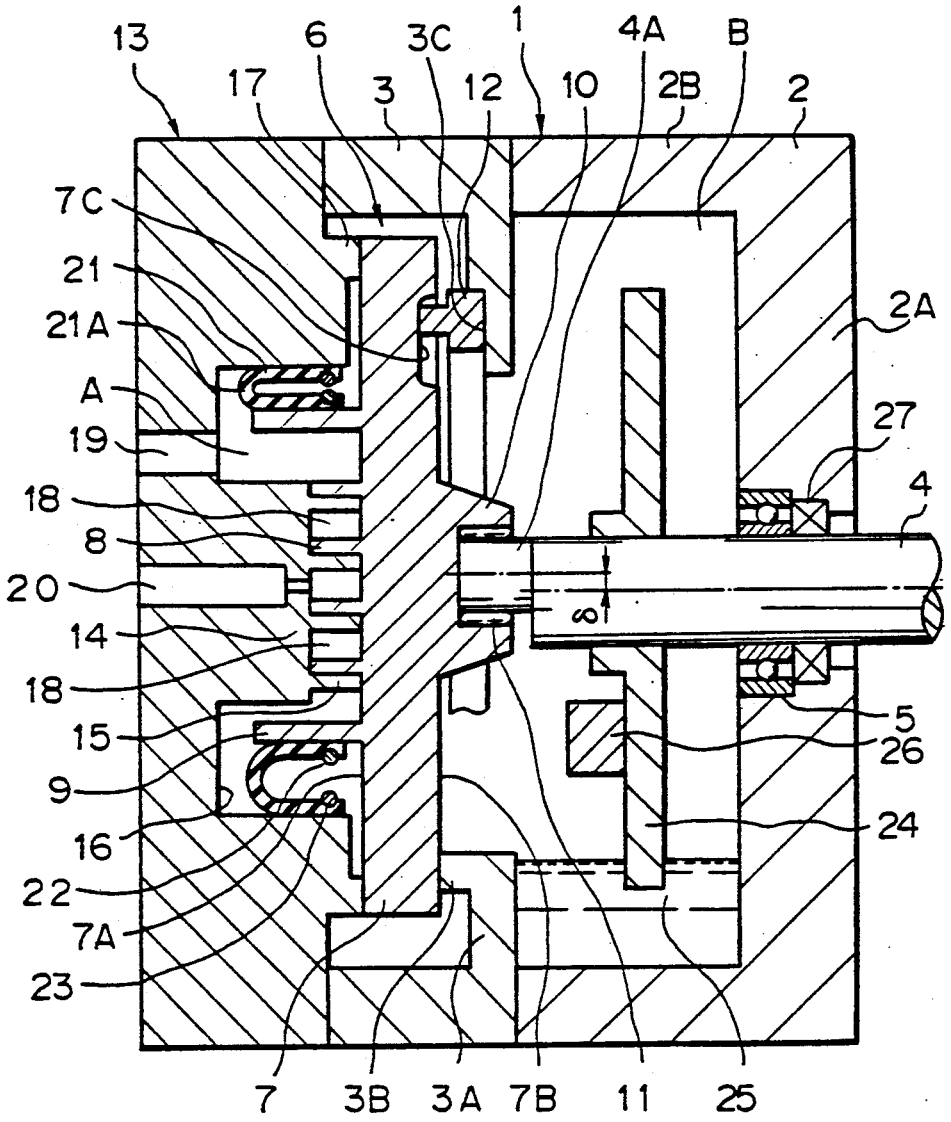
FIG. 1 is a longitudinal sectional view of a scroll vacuum pump in a preferred embodiment according to the present invention.
Figure 2:
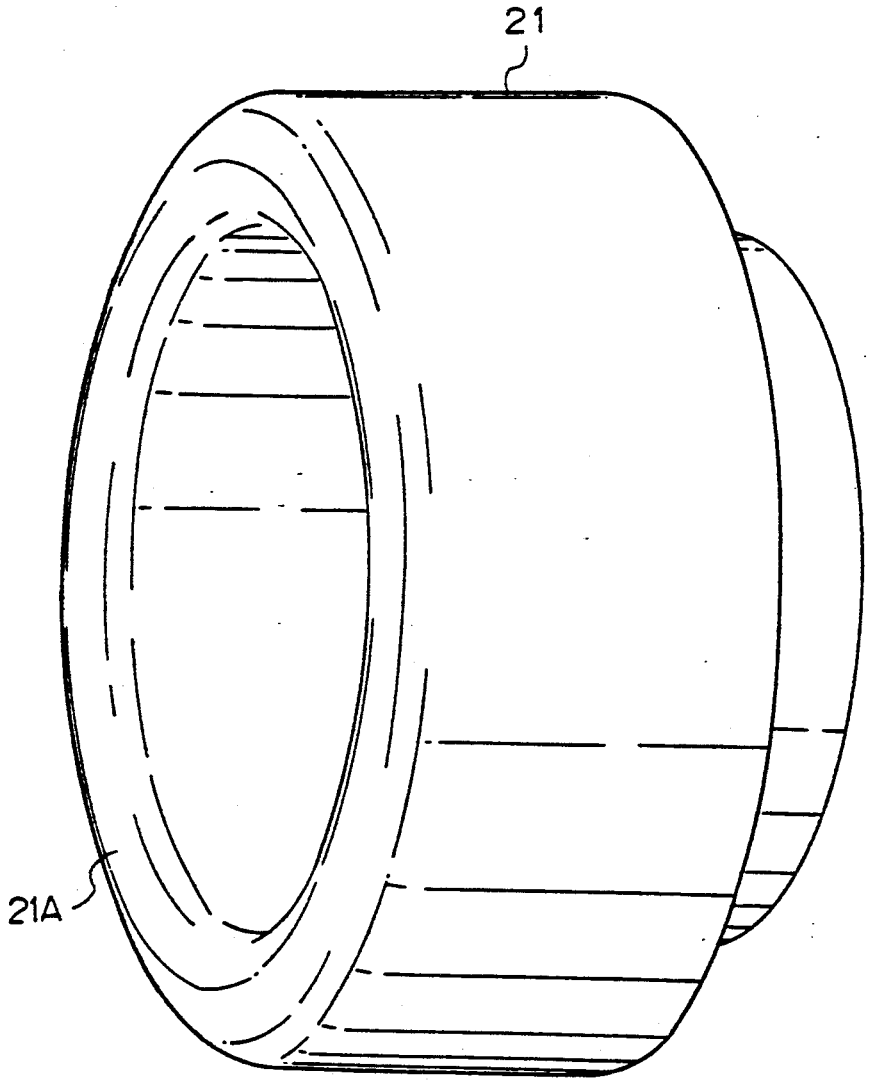
FIG. 2 is a perspective view of a sealing member incorporated into the scroll vacuum pump of FIG. 1.

Referring to FIGS. 1 and 2, a casing 1 consists of a generally cylindrical first casing member 2 and a generally cylindrical second casing member 3. The first casing member 2 has a generally cylindrical side wall 2B and a generally circular end wall 2A closing the rear end, i.e., the right-hand end as viewed in FIG. 1, of the cylindrical side wall 2B. The second casing member 3 has a diameter corresponding to that of the cylindrical side wall 2B of the first casing member 2, and is provided integrally with an inner flange 3A on its rear end, i.e., the end adjacent to the front end of the first casing member 2. The inner circumference of the inner flange 3A is bent to the front, i.e., to the left as viewed in FIG. 1, to form a thrust bearing portion 3B. Recesses 3C (only one of which is shown) are formed in the rear surface of the flange 3A at predetermined angular intervals for together receiving an Oldham's coupling 12 which will be explained later. The first casing member 2 and the second casing member 3 are joined together so that the front end of the first casing member 2 and the rear end of the second casing member 3 are in close contact with each other.

A drive shaft 4 is supported for rotation in a bearing 5 on the rear end wall 2A of the first casing member 2. The drive shaft 4 has an eccentric shaft portion 4A in its front portion, i.e., the left-hand portion as viewed in FIG. 1, extending within the casing 1. The eccentric shaft portion 4A is eccentric to the drive shaft 4 with an eccentricity δ. A motor (not shown) is connected to the rear end of the drive shaft 4 to drive the drive shaft 4 for rotation.

A scroll rotor 6 is supported by a bearing 11 on the eccentric shaft portion 4A of the drive shaft 4 for revolution relative to the eccentric shaft portion 4A. The scroll rotor 6 consists of a circular base plate 7, a scroll wrap 8 standing upright on the front surface 7A of the base plate 7 and having a spiral shape expanding from the central portion toward the circumference of the base plate 7, a cylindrical wall 9 formed on the front surface 7A of the base plate 7 so as to surround the scroll wrap 8 and having a height greater than that of the scroll wrap 8, and a boss 10 formed on the rear side 7B of the base plate 7. The boss 10 is fit on the bearing 11 mounted on the eccentric shaft portion 4A of the drive shaft 4 to mount the scroll rotor 6 on the drive shaft 4.

Grooves 7C (only one of which is shown) are formed in a peripheral portion of the rear side 7B of the scroll rotor 6 at predetermined angular intervals. The Oldham's coupling 12 is placed in the groove 7C. The Oldham's coupling 12 prevents the rotation of the scroll rotor 6 on its own axis. When driven by the drive shaft 4, the scroll rotor 6 revolves on a circular orbit having a radius δ about the center axis of the drive shaft 4.

A scroll stator 13 is joined to the front end of the second casing 3 to cover the front end of the casing 1. The scroll stator 13 consists of a base plate 14 attached to the front end of the second casing member 3 coaxially with the drive shaft 4, a scroll wrap 15 formed on the rear surface, i.e., the inner surface, of the base plate 14 in a shape complementary to that of the scroll wrap 8 of the scroll rotor 6, an annular groove 16 formed in the peripheral portion of the rear surface of the base plate 14 so as to receive the cylindrical wall 9 of the scroll rotor 6 therein, and an annular thrust bearing ridge or portion 17 formed on the rear surface of the base plate 14 so as to be in sliding contact with the base plate 7 of the scroll rotor 6 to sustain a thrust.

The scroll wrap 8 of the scroll rotor 6 is dislocated through a predetermined angle relative to the scroll wrap 15 of the scroll stator 13 to define a plurality of closed compression chambers 18, which are compressed continuously as the scroll stator revolves. A suction port 19 and a discharge port 20 are formed in the scroll stator 13. The suction port 19 opens into the annular groove 16 communicating with the radially outermost compression chamber 18. The discharge port 20 is formed in the central portion of the base plate 14 so as to open into the radially innermost compression chamber 18.

A sealing member 21 is placed between the outer circumference of the cylindrical wall 9 of the scroll rotor 6 and the inner circumference of the annular groove 16 of the scroll stator 13. The inner and outer lips of the sealing member 21 are fastened by loading springs 22 and 23 to the outer circumference of the cylindrical wall 9 of the scroll rotor 6 and the inner circumference of the annular groove 16 of the scroll stator 13, respectively. The sealing member 21 is formed of a flexible material in a shape having a U-shaped cross section as shown in FIG. 2. The sealing member 21 is disposed on the radially inner side of the thrust bearing portion 17 of the scroll stator 13 so as to define a suction chamber A communicating with the suction port 19. The sealing member 21 seals the suction chamber A and completely eliminates communication between the suction chamber A and the interior B of the casing 1 by means of, for example, the interface between the thrust bearing portion 17 and the base plate 7 of the scroll rotor 6.

A splash plate 24 is fixedly mounted on the drive shaft 4 in a space surrounded by the cylindrical side wall 2B of the first casing member 2. The splash plate 24 is partially immersed in lubricating oil 25 contained in the casing 1 to splash the lubricating oil 25 onto the bearings 5 and 11, and the thrust bearing portions 3B and 17 for lubrication and cooling. The splash plate 24 is provided with a balancing weight 26 to secure the dynamic balance of the drive shaft 4. An oil seal 27 is provided behind the bearing 5 on the rear wall 2A of the first casing member 2 to prevent leakage of the lubricating oil 25.

The operation of the scroll vacuum pump thus constructed will be described hereinafter. The suction port 19 is connected to a closed vessel, such as a vacuum tank, not shown, by a pipe, not shown. When the drive shaft 4 is rotated by a motor, the scroll stator 6 supported by the bearing 11 on the eccentric shaft portion 4A revolves about the axis of the drive shaft 4 along a circular orbit of a radius δ to expand and compress the compression chambers 18 alternately, whereby air is sucked from the closed vessel into and compressed in the compression chambers 18 to evacuate the closed vessel, and the compressed air is discharged through the discharge port 20.

Since the suction chamber A communicating with the suction port 19, and the compression chamber 18 are hermetically isolated from the interior B of the casing 1 by the sealing member 21, the pressure in the suction chamber A temporarily increases beyond the atmospheric pressure in the initial operation state, while the pressure in the interior B of the casing 1 remain at the atmospheric pressure. Consequently, the scroll rotor 6 is pressed against the second casing member 3 with the rear side 7B of the base plate 7 in sliding contact with the thrust bearing portion 3B of the second casing member 3. As the scroll vacuum pump operates continuously, the pressure in the suction chamber A drops gradually to a negative pressure below the atmospheric pressure prevailing in the interior B of the casing 1. Consequently, the scroll rotor 6 is pressed against the scroll stator 13 with the front surface 7A of the base plate 7 in sliding contact with the thrust bearing portion 17 of the scroll stator 13. Thus, the thrust bearing portions 3B and 17 sustain the thrusts acting in opposite directions, respectively, on the scroll rotor 6.

During the pumping operation of the scroll vacuum pump, the splash plate 24 mounted on the drive shaft 4 splashes the lubricating oil 25 contained in the interior B of the casing 1 kept in complete isolation from the suction chamber A by the sealing member 21 onto the bearings 5 and 11, and the interfaces between the base plate 7 of the scroll rotor 6 and the thrust bearing portions 3B and 17 maintaining effective lubrication and cooling thereof.

The sealing member 21 is formed of a flexible material having a U-shaped cross section and varies in shape in accordance with the revolution of the scroll rotor 6 to ensure the smooth revolution of the scroll rotor 6 relative to the scroll stator 13. The sealing member 21 effectively prevents leakage of the lubricating oil 25 splashed in the interior B of the casing 1 into the suction chamber A, so that oil-free, clean air is discharged through the discharge port 20.

Thus, the bearings 5 and 11, the scroll rotor 6 and the thrust bearing portions 3B and 17 are satisfactorily lubricated and cooled thereby effectively preventing abrasion thereof and also preventing any thermal deformation of the scroll rotor 6 resulting from excessive rise in the temperature of the scroll rotor 6. Accordingly, the clearances to be set up between the front surface of the base plate 7 and the extremity of the scroll wrap 15 of the scroll stator 13 and between the inner surface of the scroll stator 13 and the extremity of the scroll wrap 8 of the scroll rotor 6 can be reduced, so that the leakage of air across the compression chambers 18 can be prevented and hence the closed vessel can be rapidly evacuated. Cooling the scroll rotor 6 from behind the rear side 7B enables the scroll vacuum pump to operate continuously and prevents scuffing between the base plates 7 and 14 due to thermal expansion of the scroll wrap 8 and 15.

Since the sealing member 21 is preformed with a U-shaped cross section instead of folding a cylindrical packing in the shape of the sealing member 21 when fitting the cylindrical packing in place, neither compressive stress nor tensile stress is present in the curved portion 21A of the sealing member 21. The U-shaped cross section prevents the concentration of stress on a particular portion of the sealing member 21 and facilitates the fitting in place of the sealing member 21.

A scroll vacuum pump in a second embodiment according to the present invention will be described hereinafter with reference to FIG. 3, in which parts like or corresponding to those previously described with reference to FIGS. 1 and 2 are denoted by the same reference numerals and the description thereof is omitted.

Figure 3:
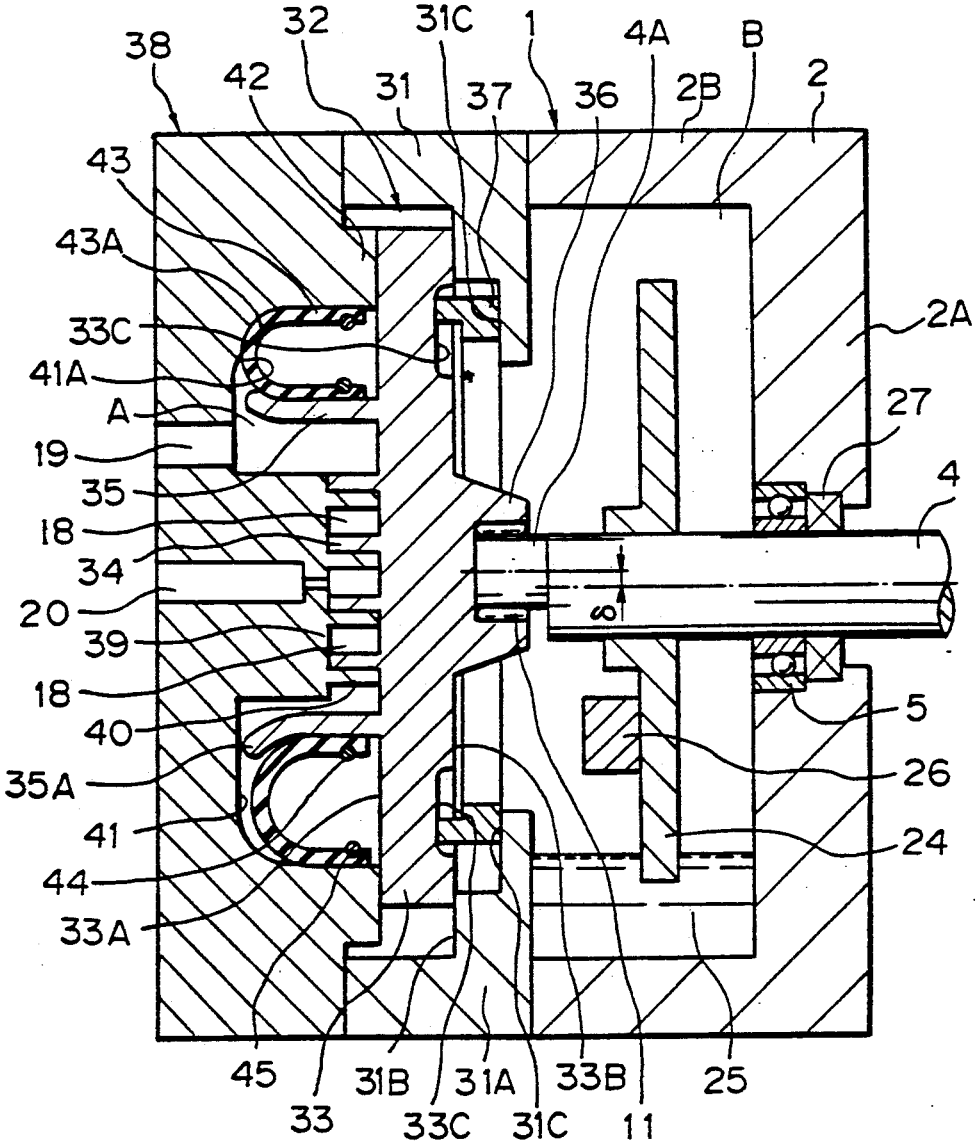
FIG. 3 is a longitudinal sectional view of a scroll vacuum pump in a second embodiment according to the present invention.

The scroll vacuum pump shown in FIG. 3 is characterized in that the bottom surface of the suction chamber A of the scroll stator, and the cylindrical wall of the scroll rotor are curved in conformity with the curved portion of the sealing member.

Referring to FIG. 3, a casing 1 consists of a first casing member 2 and a second casing member 31. The second casing member 31 is substantially similar in shape and function to the second casing 3 of the first embodiment, except that the second casing 31 is provided integrally with an inner flange 31A different in shape from the inner flange 3A. Formed in a portion of the flange 31A is a thrust bearing portion 31B which sustains a thrust when the rear side 33B of a scroll rotor 32 comes into sliding contact therewith. Recesses 31C are formed in the flange 31A at predetermined angular intervals for together receiving an Oldham's coupling 37.

The scroll rotor 32 is supported for rotation by a bearing 11 mounted on the eccentric shaft portion 4A of a drive shaft 4. Similarly to the scroll rotor 6 of the first embodiment, the scroll rotor 32 has a base plate 33, a scroll wrap 34, a cylindrical wall 35 and a boss 36. The brim of the cylindrical wall 35 is curved radially outward to form a guide portion 35A. The edges of the guide portion 35A are rounded. Grooves 33C are formed in the peripheral portion of the rear side 33B of the base plate 33 at predetermined angular intervals. An Oldham's coupling is received in each groove 33C. The Oldham's couplings 37 prevent the rotation of the scroll rotor 32 on its own axis.

A scroll stator 38 is joined to the front end of the second casing member 31 to cover the front opening of the casing 1. Similarly to the scroll stator 13 of the first embodiment, the scroll stator 38 has a base plate 39, a scroll wrap 40, an annular groove 41 and an annular thrust bearing portion 42. The outer portion of the bottom surface of the annular groove 41 is rounded in a shape conforming to the curved portion 43A of a sealing member 53 to form a curved guide surface 41A. The sealing member 43 is fitted in an annular space between the cylindrical wall 35 of the scroll rotor 32 and the annular groove 41 of the scroll stator 38. The lips of the sealing member 43 are fastened to the outer circumference of the cylindrical wall 35 of the scroll rotor 32 and the outer circumference of the annular groove 41 of the scroll stator 38 by loading springs 44 and 45, respectively. The sealing member 43 is formed of a flexible material so as to be substantially similar to the sealing member 21, having a U-shaped cross section and the curved portion 43A. The sealing member 43 completely seals a suction chamber A and prevents the communication of the suction chamber A with the interior B of the casing 1 by means of interfaces between the thrust bearing portion 42 and the base plate 33 and between the thrust bearing portion 31B and the base plate 33. Thus, the suction chamber A and the interior B of the casing 1 are completely isolated from each other.

The action and effect of the scroll vacuum pump in the second embodiment are substantially the same as those of the scroll vacuum pump in the first embodiment. In the second embodiment, the guide portion 35*a* of the cylindrical wall 35 of the scroll rotor 32 and the guide surface 43A of the suction chamber A of the scroll stator 38 suppress the excessive deformation of the sealing member 43, so that the life of the sealing member 43 is extended.

Although the invention has been described in relation to scroll vacuum pumps, the present invention is not limited thereto in its application. For example, the present invention may be embodied in a compressor for compressing various gases including air. In such an application, part of the compressed gas discharged from the discharge port 20 is supplied into the interior B of the casing to apply a back pressure to the rear side 7B (33B) of the scroll rotor 6 (32) to bias the scroll rotor 6 (32) toward the scroll stator 13 (38).

Furthermore, the interior B of the casing 1 may be open to the atmosphere to cool the components positively by the ambient air.

Although the invention has been described in its preferred forms with a certain degree of particularity, obviously many changes and variations are possible therein. It is therefore to be understood that the present invention may be practiced otherwise than as specifically described herein without departing from the spirit and scope thereof.

What is claimed is:

1. A scroll fluid machine comprising:

a casing;

a drive shaft journaled on the casing for rotation and having an eccentric shaft portion extending within the casing;

a scroll rotor supported through a bearing on the eccentric portion of the drive shaft, and having a base plate and a scroll wrap projecting from one major surface of the base plate;

a scroll stator fixedly attached to the casing, and having a base plate provided with a suction port in its peripheral portion and a discharge port in its central portion and a scroll wrap projecting from the base plate and defining a closed space together with the scroll wrap of the scroll rotor;

wherein thrust bearing portions are formed at peripheral portions of the scroll stator and the scroll rotor, respectively, to sustain thrusts acting on the scroll rotor, said thrust bearing portions being located on the radially outer portions of the stator and rotor, respectively, and a sealing member is provided in a space defined between and by the scroll rotor and the scroll stator and communicating with the suction port, said sealing member being located radially inwardly of the thrust bearing portions; and wherein said scroll rotor is provided with a cylindrical wall extending from said one major surface of the base plate thereof, and wherein said sealing member includes inner and outer lip portions, said inner lip portion being secured onto said cylindrical wall.

2. A scroll fluid machine according to claim 1, wherein said sealing member is preformed of a flexible sealing material in a U shape.

3. A scroll fluid machine according to claim 2, wherein said cylindrical wall includes a brim portion at a free end thereof, said brim portion being curved radially outward.

4. A scroll fluid machine according to claim 1, wherein said cylindrical wall includes a brim portion at a free end thereof, said brim portion being curved radially outward.

* * * * *